US010814460B2

(12) United States Patent
Otterson

(10) Patent No.: US 10,814,460 B2
(45) Date of Patent: Oct. 27, 2020

(54) RATCHET WRENCH WITH FINE SOCKET-INDEXING MACHANISM

(71) Applicant: Randy Otterson, North River (CA)

(72) Inventor: Randy Otterson, North River (CA)

( * ) Notice: Subject to any disclaimer, the term of this patent is extended or adjusted under 35 U.S.C. 154(b) by 191 days.

(21) Appl. No.: 15/731,657

(22) PCT Filed: Dec. 31, 2015

(86) PCT No.: PCT/CA2015/000609

§ 371 (c)(1),
(2) Date: Jul. 12, 2017

(87) PCT Pub. No.: WO2016/112453

PCT Pub. Date: Jul. 21, 2016

(65) Prior Publication Data

US 2018/0043511 A1 Feb. 15, 2018

Related U.S. Application Data

(60) Provisional application No. 62/125,234, filed on Jan. 16, 2015.

(51) Int. Cl.
*B25B 13/46* (2006.01)
*B25B 13/04* (2006.01)

(52) U.S. Cl.
CPC ..... *B25B 13/467* (2013.01); *B25B 13/04* (2013.01); *B25B 13/462* (2013.01)

(58) Field of Classification Search
CPC ..... B25B 13/467; B25B 13/04; B25B 13/462; B25B 17/00; B25B 13/466; B25B 13/481; B25B 21/002
USPC ..... 81/57.46
See application file for complete search history.

(56) References Cited

U.S. PATENT DOCUMENTS

| | | | | |
|---|---|---|---|---|
| 2,288,217 A | | 6/1942 | Trautman | |
| 2,290,197 A | * | 7/1942 | Merriman | B25B 13/467 81/57.46 |
| 2,292,391 A | | 8/1942 | Merriman et al. | |
| 2,530,553 A | | 11/1950 | Strobell | |
| 2,603,998 A | | 7/1952 | Schwartz | |
| 2,726,563 A | * | 12/1955 | Blackburn | B25B 13/467 81/57.39 |
| 2,733,745 A | | 2/1956 | Norwood | |
| 2,806,396 A | | 9/1957 | Miller | |

(Continued)

*Primary Examiner* — David B. Thomas
*Assistant Examiner* — Thomas Raymond Rodgers
(74) *Attorney, Agent, or Firm* — Mario Theriault

(57) ABSTRACT

A method for operating a ratchet wrench having a tangential belt drive mechanism and a ratchet gear therein, including the steps of momentary pulling on the driven end of the belt for rotating the ratchet gear during a forward cycle; continually applying a first resilient tension force on the return end of the belt; continually applying a resilient compression force on the driven end of the belt of a same magnitude as the first resilient tension force toward the return end of the belt, and relaxing the step of pulling and allowing the belt to return to an initial position of the belt before the step of pulling. In another aspect of the present invention, there is provided a tangential drive mechanism comprising a first and second springs, one on each side of the ratchet gear and each acting on the belt toward a return end of the belt.

5 Claims, 3 Drawing Sheets

(56) References Cited

U.S. PATENT DOCUMENTS

| | | | | | |
|---|---|---|---|---|---|
| 3,200,676 | A * | 8/1965 | Pagel | B25B 13/04 | 81/64 |
| 3,368,432 | A | 2/1968 | Halls | | |
| 3,640,159 | A | 2/1972 | Halls et al. | | |
| 3,731,722 | A | 5/1973 | Carr | | |
| 3,901,107 | A | 8/1975 | Halls | | |
| 4,184,390 | A | 1/1980 | Evans | | |
| 4,491,042 | A | 1/1985 | Lopochonsky | | |
| 4,507,989 | A | 4/1985 | Baker | | |
| 4,532,833 | A | 8/1985 | Downs | | |
| 4,592,254 | A | 6/1986 | Wallis | | |
| 4,656,894 | A * | 4/1987 | Goetz | B25B 13/00 | 81/57.43 |
| 4,867,016 | A | 9/1989 | Di Edwardo | | |
| 5,509,705 | A | 4/1996 | Woodsum | | |
| 5,692,789 | A | 12/1997 | Woodsum | | |
| 5,768,957 | A * | 6/1998 | Baker | B25B 13/467 | 74/105 |
| 6,167,785 | B1 | 2/2001 | Penner | | |
| 6,748,826 | B2 | 6/2004 | Marks | | |
| 6,761,092 | B2 | 7/2004 | Hsien | | |
| 6,789,450 | B1 | 9/2004 | Helfet | | |
| 7,320,267 | B1 * | 1/2008 | Chen | B25B 13/463 | 81/57.3 |
| 7,331,259 | B1 | 2/2008 | Chen | | |
| 8,196,494 | B2 | 6/2012 | Brovold | | |

* cited by examiner

RATCHET WRENCH WITH FINE SOCKET-INDEXING MACHANISM

FIELD OF THE INVENTION

This invention pertains to ratchet wrenches, and more particularly, it pertains to a ratchet wrench having a fine adjustment mechanism for indexing or rotating the socket thereof without moving the free end of the wrench.

BACKGROUND OF THE INVENTION

When using a ratchet wrench, the available space for movement of the handle is often less than the angle between the notches of the ratchet gear of the wrench. In the past, several inventions were developed to address this problem. The following publications represent a good inventory of the inventions found in the prior art describing tangential drive mechanisms, where a belt, a cable or a chain is wrapped around the ratchet gear of a ratchet wrench. The belt, cable or chain is worked from the free end of the wrench to rotate the ratchet gear with sufficient torque to drive a nut or a bolt to and from a face engagement thereof.

U.S. Pat. No. 2,288,217 issued to E. C. Trautman on Jun. 30, 1942;

U.S. Pat. No. 2,290,197 issued to H. H. Merriman et al., on Jul. 21, 1942;

U.S. Pat. No. 2,292,391 issued to H. H. Merriman et al., on Aug. 11, 1942;

U.S. Pat. No. 2,530,553 issued to J. D. Strobell on Nov. 21, 1950;

U.S. Pat. No. 2,733,745 issued to L. Norwood on Feb. 7, 1956;

U.S. Pat. No. 4,184,390 issued to J. P. Evans on Jan. 22, 1980;

U.S. Pat. No. 4,491,042 issued to J. E. Lopochonsky on Jan. 1, 1985;

U.S. Pat. No. 4,507,989 issued to R. W. Baker on Apr. 2, 1985;

U.S. Pat. No. 4,592,254 issued to F. A. Wallis on Jun. 3, 1986;

U.S. Pat. No. 4,867,016 issued to W. Di Edwardo on Sep. 19, 1989;

U.S. Pat. No. 7,320,267 issued to Y. T. Chen on Jan. 22, 2008;

U.S. Pat. No. 8,196,494 issued to T. E. Brovold on Jun. 12, 2012.

In another arrangement found in the prior art, a belt is positioned to enclose a nut. The belt is pulled from the end of a long handle to rotate the nut on a threaded stem.

U.S. Pat. No. 3,200,676 issued to A. B. Pagel on Aug. 17, 1965.

In yet another previous invention, the following document discloses a socket and a string wound around the socket for rotating a nut on a bolt from a remote location by pulling on the string.

U.S. Pat. No. 6,167,785 issued to V. Penner on Jan. 2, 2001.

While the inventions in the prior art deserve undeniable merits, there is a common inconvenience with the use of a tangential belt or cable enclosing a ratchet gear. This drawback is related to a phenomenon encountered with a cable wrapped around a drum. This phenomenon is often referred to as the principle of the capstan equation, where the tension of a cable or a belt wrapped around a drum may be different on either side of the drum. In fact a small force exerted on one end of the cable on one side of the drum can carry a much larger loading force on the other side of the drum. A double turn of a rope around the drum of a capstan for example can retain a large ship to a wharf, even when the other end of the rope is laying loosely on the deck of the ship.

This phenomenon is also encountered during the return cycle of a tangential drive ratchet wrench, when the belt, cable or chain must slip over the ratchet gear to return to its starting point. While some of the mechanisms found in the prior art have a spring attached to the return end of the belt, cable or chain, even a small tension on the pulling end can prevent the belt, cable or chain from sliding back.

A slight tension on the pulling end of the belt, during the return cycle of the belt, increases the friction force between the belt and the crest and driven segments of the ratchet gear. The resulting holding force is increased exponentially from that slight tension by a factor corresponding to the friction coefficient between the belt and the surface of the ratchet gear and the surface contact area of the belt with the ratchet gear.

For example, a lack of manual coordination by the user in releasing the pulling end of the belt can make it very difficult to operate the wrench. Any hesitation or muscular tremor in fully releasing the pulling end of the belt causes the belt to stick, to grab and to block halfway along the return cycle of the belt.

Because of this phenomenon, a tangential drive on a ratchet wrench experiences a poor performance every time the user is not in perfect synchronization with the speed and amplitude of the mechanism.

It is believed that this principle of the capstan equation occurring in tangential drive ratchet wrenches has contributed to diminish public confidence in tangential driven wrenches and as a consequence, this capstan equation effect has been detrimental in limiting the commercial success of these wrenches.

Therefore, it is believed that a market demand exists for a better design of a tangential drive ratchet mechanism, where the principle of the capstan equation has no negative effect on the operation of the mechanism.

SUMMARY OF THE PRESENT INVENTION

In the present invention, there is provided a ratchet wrench with a fine socket-indexing mechanism that eliminates the capstan equation phenomenon. A second spring is provided to counteract the effect of the return spring and to remove any surface friction between the belt and the driven and crest segments of the ratchet gear. The tangential belt slides back easily on the driven, reverse and crest segments of the ratchet gear so that the operation of the wrench is smooth, positive and firm.

In a first aspect of the present invention, there is provided a tangential drive mechanism for a ratchet gear. The mechanism includes a ratchet gear having a driven segment, a return segment and a crest segment between the driven segment and the return segment. A belt is mounted around the ratchet gear. The belt has a driven end which is movable away from the ratchet gear for driving the ratchet gear in a rotational direction, and toward the ratchet gear during a belt return cycle. The belt also has a return end opposite the driven end. The return end also extends away from the ratchet gear. In this mechanism, a return spring is attached to the return end of the belt for applying a tension force on the return end. A return-assist spring is attached to the driven end of the belt for applying a compression force on the driven end of a same magnitude as the tension force, toward the return end. Because of this compression force, the belt has no surface pressure along the crest segment and the driven segment of the ratchet gear and can easily disengage from the ratchet gear during the belt return cycle. Because of this return-assist spring, basically, the capstan equation phenomenon is eliminated from this mechanism.

In another aspect of the present invention, there is provided a ratchet wrench having a stem and a box end at the end of the stem. The box end includes a socket mounted therein. A ratchet gear is mounted in the box end around the socket. The ratchet gear has a driven segment, a return segment and a crest segment between the driven segment and the return segment. A belt is mounted around the ratchet gear. The belt has a driven end movable away from the ratchet gear along the stem for driving the ratchet gear in a socket rotation direction. The driven end is movable toward the ratchet gear during a belt return cycle. The belt also has a return end opposite the driven end. The return end also extends along the stem, and is movable toward and away from the ratchet gear.

A return spring is attached to the stem and to the return end of the belt for applying a tension force on the return end. A return-assist spring is attached to the driven end of the belt and to the stem for applying a compression force on the driven end of a same magnitude as the tension force, toward the return end. In a same way as the mechanism previously described, the belt has no surface pressure along the crest segment and the driven segment of the ratchet gear and can easily disengage from the ratchet gear during the belt return cycle.

In yet another aspect of the present invention, there is provided a magnetic nut retainer for use with a box-end socket wrench having a nominal socket size. This magnetic nut retainer comprises a flange having an annular disc-like configuration, and a magnetic element having an annular disc-like configuration with hexagonal circumference. The magnetic element has magnetic properties. The magnetic element is smaller in outside diameter than the flange and it is affixed in a concentric manner to the flange. The magnetic element and the flange have a hole through their respective centers of a nominal size corresponding to the size of the socket. The hexagonal circumference of the magnetic element is smaller than the nominal socket size, and the flange is larger than the socket size for retaining the magnetic element inside one end of the socket.

In yet another aspect of the present invention, there is provided a method for operating the previously described ratchet wrench. This method comprises the steps of:

momentary pulling on the driven end of the belt for rotating the ratchet gear during a forward cycle;

continually applying a first resilient tension force on the return end of the belt;

continually applying a resilient compression force on the driven end of the belt of a same magnitude as the first resilient tension force, toward the return end; and relaxing the step of pulling and allowing the belt to return to an initial position of the belt before the step of pulling.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

A preferred embodiment of the ratchet wrench according to the present invention is described with the aid of the accompanying drawings, in which like numerals denote like parts throughout the several views.

The drawings presented herein are presented for convenience to explain the functions of all the elements includes in the preferred embodiment of the present invention. Elements and details that are obvious to the person skilled in the art may not have been illustrated. Conceptual sketches have been used to illustrate elements that would be readily understood in the light of the present disclosure. These drawings are not fabrication drawings, and should not be scaled.

DESCRIPTION OF THE PREFERRED EMBODIMENT

Figure 2:
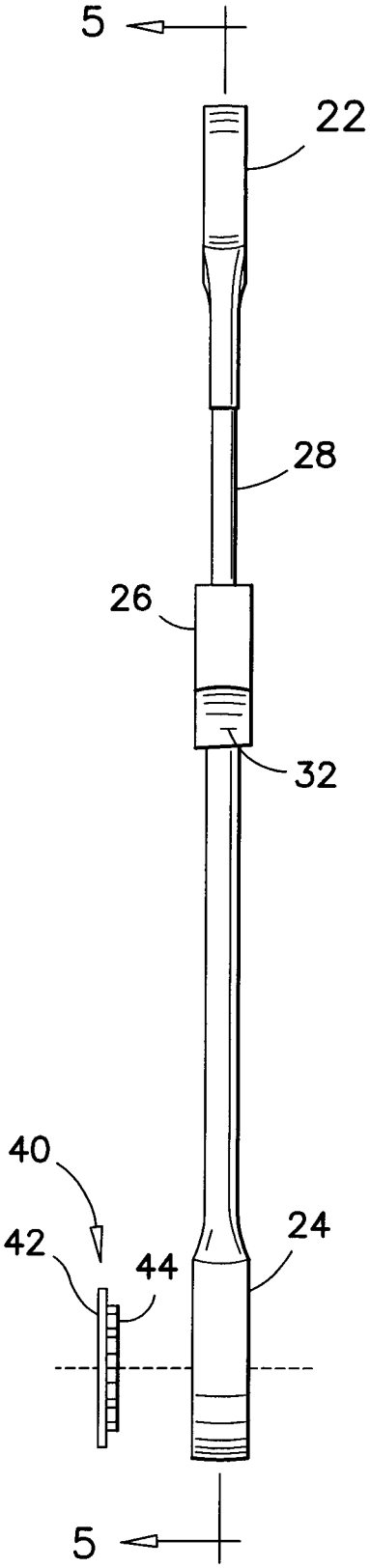
FIG. 2 is a side view of the preferred ratchet wrench, with a side view of a magnetic nut retainer which is optionally used with the preferred ratchet wrench.
Figure 1:
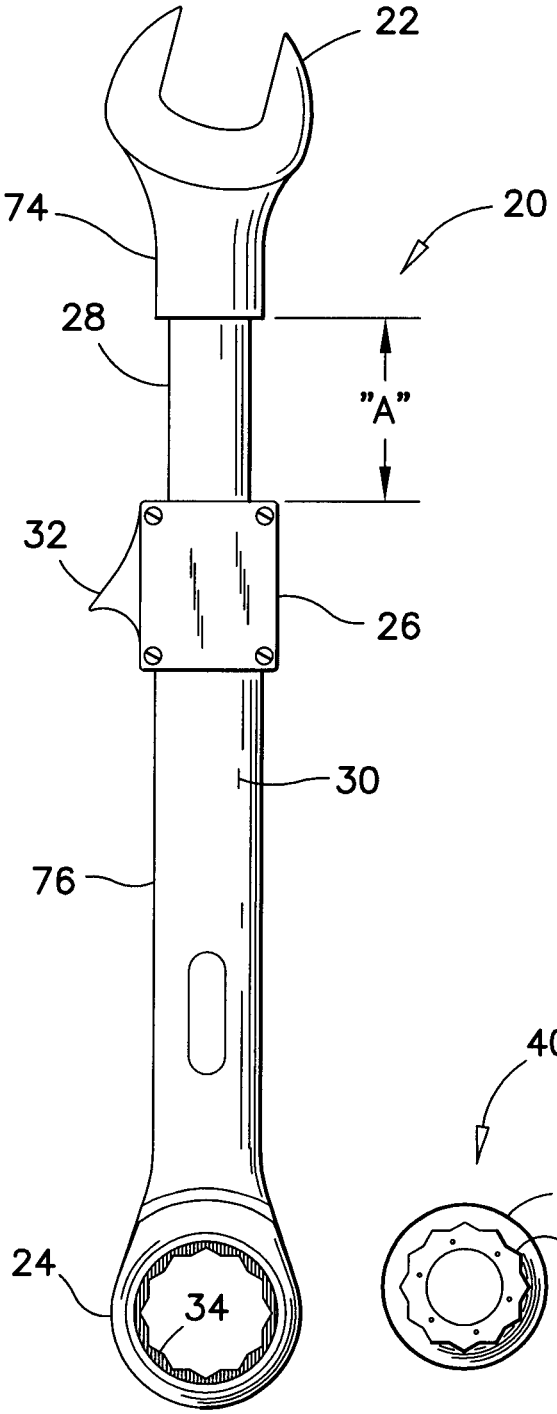
FIG. 1 is a plan view of the preferred ratchet wrench.

Referring firstly to FIGS. 1 and 2, there are illustrated therein a ratchet wrench 20 with a fine socket-indexing mechanism according to the preferred embodiment of the present invention. The preferred wrench 20 is presented herein as having an open end 22 and a box end 24. The preferred wrench 20 has a slider body 26 that is movable along a guide segment 28 along a shank portion 30 of the wrench. The slider body 26 preferably has a thumb knob 32 on one side thereof.

Although a single box end 24 is illustrated and described herein, it will be appreciated that a duplication of the structure and elements described herein can be made to obtain a double-ended box wrench with a different socket size at each end.

Similarly, although a ratchet wrench is illustrated and described as the preferred embodiment of the present invention, the tangential drive system described herein can be applied to other mechanisms. For example, it is believed that the tangential drive system described herein can be used to operate an out-of-reach industrial gate valve, or other similar hard-to-access equipment having an actuator mounted to a threaded stem. Therefore, the tangential drive system described herein is not limited to ratchet wrenches.

The box end 24 of the preferred wrench 20 is made of an hexagonal socket 34 encircled by a ratchet gear (illustrated elsewhere) mounted therein. The ratchet gear is operable in one direction by a pawl-type latching device as is customary with ratchet wrenches.

Figure 3:
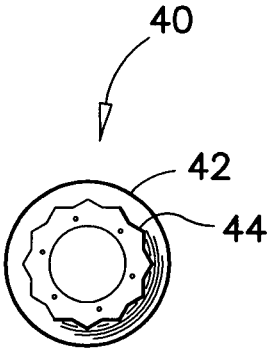
FIG. 3 is an inside plan view of the magnetic nut retainer illustrated in FIG. 2.

Referring to FIGS. 2 and 3, the preferred ratchet wrench 20 is preferably used with a magnetic nut retainer 40 to help retain a nut inside the socket 34. This nut retainer 40 is made of a flange 42 and a thin hexagonal-shaped magnetic element 44 which has dimensions to register into the hexagonal cavity of the socket 34. Because of the dimensions of the hexagonal shape of the magnetic element, this element 44 is retained inside one end of the socket 34. It will be appreciated that the nut retainer 40 can be placed in one end of the socket 34 or the other. The nut retainer 40 is used to retain a nut inside the socket 34 whether the wrench 20 is used to tighten a nut or to remove a nut from a bolt. Both the flange 42 and the magnetic element 44 have a hole in their centers to accommodate a bolt of the same nominal size as the hexagonal cavity of the socket 34.

Other structural elements of the preferred wrench 20 are illustrated in FIGS. 4-9. The operation of the preferred wrench 20 will also be described using these illustrations.

Figure 4:
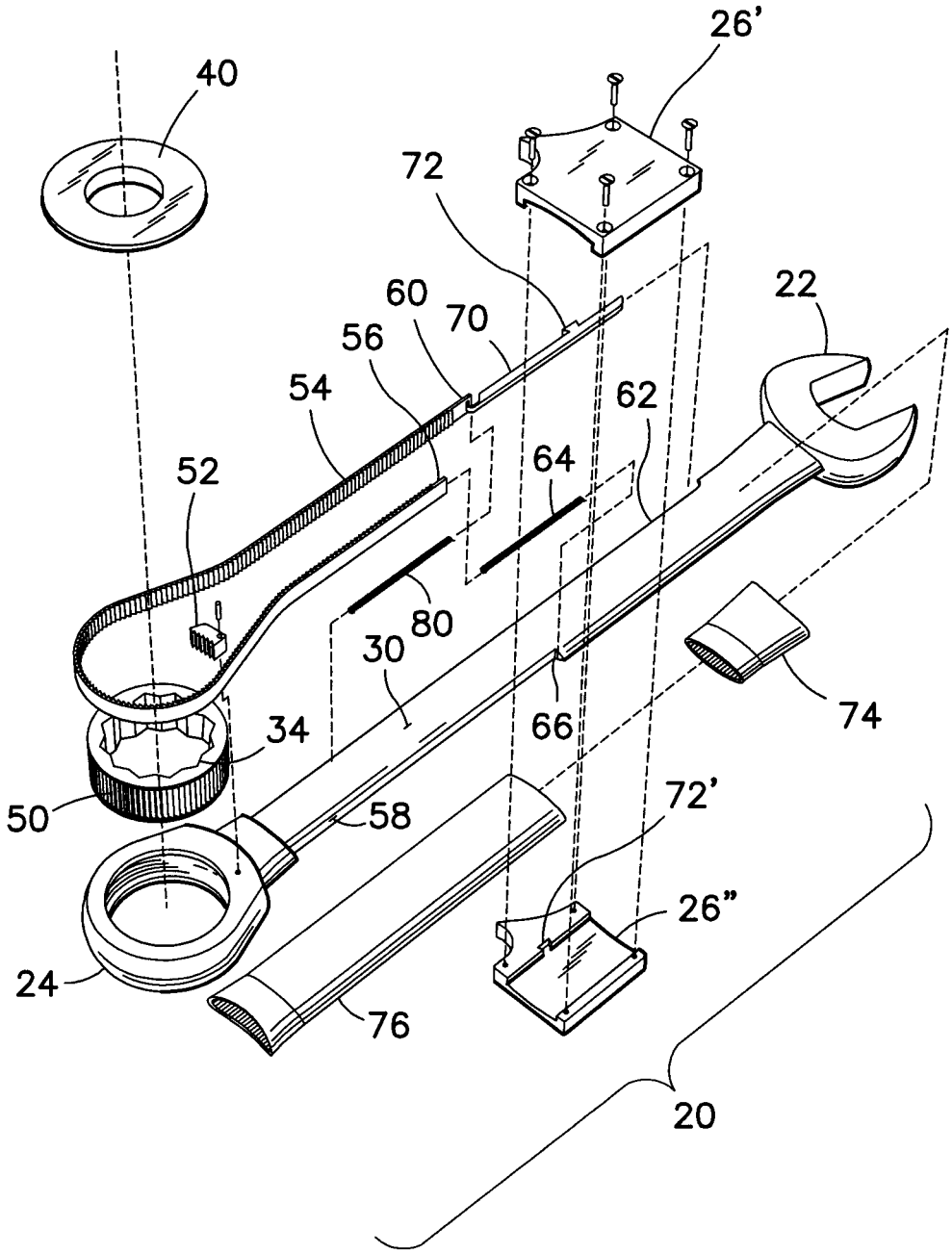
FIG. 4 is an exploded view of the preferred ratchet wrench and the magnetic nut holder shown in FIGS. 1, 2 and 3.

The ratchet gear 50 encircling the hexagonal socket 34 is illustrated in FIG. 4. This ratchet gear 50 is mounted inside the box end 24 of the preferred socket wrench 20 by way of a snap ring (not shown) for example. A movable pawl 52 is also mounted inside the cavity of the box end 24, as it is customary with ratchet wrenches.

A toothed belt 54, is mounted around the ratchet gear 50. Both ends of the belt 54 extend along the shank 30 of the wrench 20. The shank 30 of the wrench 20 has spring seats that have been milled away, one on each side of the shank 30. The return end 56 of the toothed belt 54 extends along a first spring seat 58. The driven end 60 of the toothed belt 54 extends along a second spring seat 62. For reference purposes, the first spring seat 58 is referred to as the return side spring seat 58, and the second spring seat 62 is referred to as the driven side spring seat 62. The spring seats 58 and 62 also designate the return side and the driven side of the wrench 20.

Figure 5:
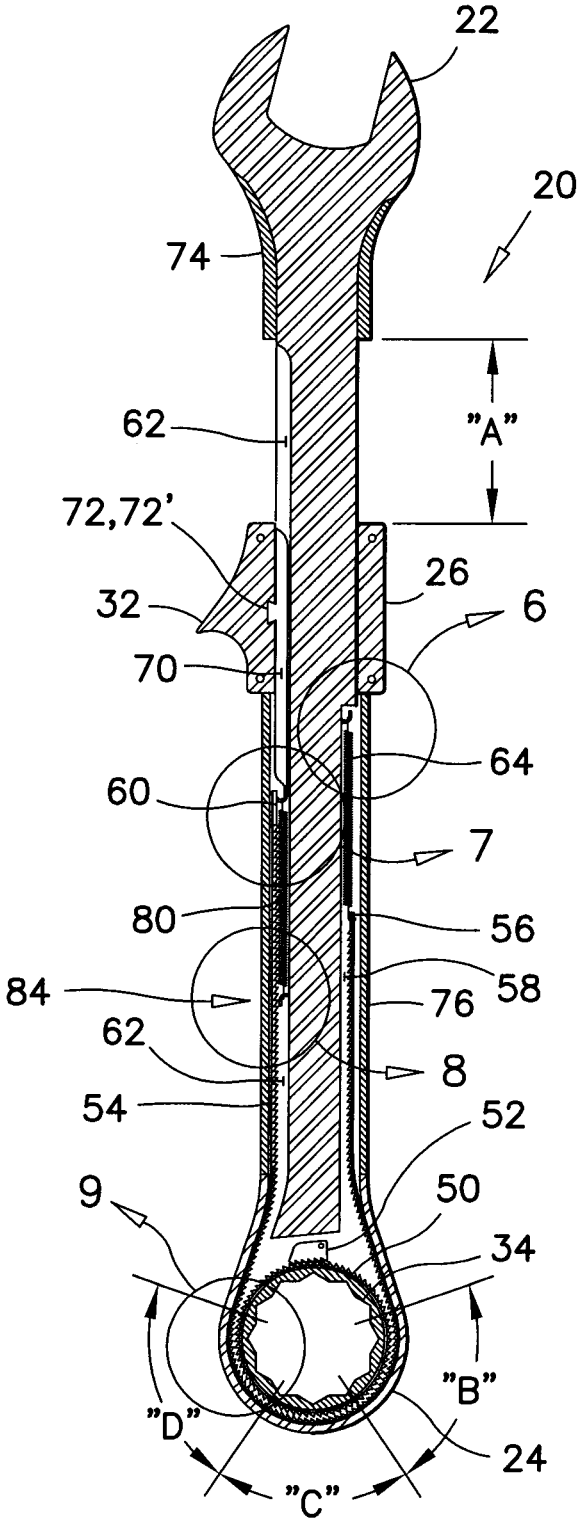
FIG. 5 is a cross-section view of the preferred wrench as viewed along lines 5-5 in FIG. 2.
Figure 6:
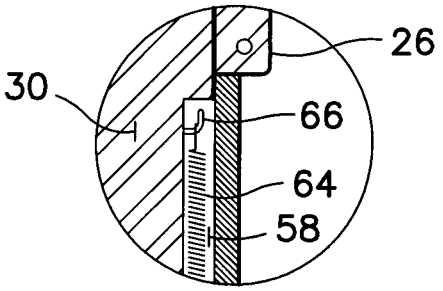
FIG. 6 is an enlarged illustration of the structural details included in detail circle 6 in FIG. 5.
Figure 7:
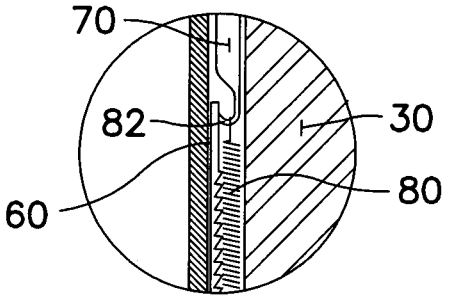
FIG. 7 is an enlarged illustration of the structural details included in detail circle 7 in FIG. 5.

A return spring 64 has one end thereof attached to the return end 56 of the toothed belt 54, and a second end connected to a first anchor hook 66 at the far end of the return side spring seat 58 as can be seen in FIGS. 5 and 6. This return spring 64 is an extension type spring. This return spring 64 is used to pull back on the toothed belt 54 during a return cycle of the belt 54, when the slider body 26 is released.

The driven end 60 of the toothed belt 54 is attached to a sliding bar 70, which slides back and forth frictionless along the driven spring seat 62. The sliding bar 70 is linked to the slider body 26 by means of a dovetail engagement as can be seen at labels 72 and 72' in FIGS. 4 and 5.

The slider body 26 is made of two halves 26', 26", which enclose the shank 30 of the preferred wrench in a sliding fit mounting. The movement "A" of the slider body 26 along the guide segment 28 is limited by the collars of a first 74 and second 76 sleeves mounted over the shank 30 of the preferred wrench 20. The movement "A" is about 1 inch to 1¼ inch. This distance "A" is equivalent to a comfortable movement of a user's thumb. Both sleeves 74, 76 are made of a rubberized plastic material, offering a comfortable grip on the preferred wrench 20.

Referring to FIG. 5, the ratchet gear 50 is movable in a clockwise direction and is blocked by the pawl 52 in the counterclockwise direction.

Figure 8:
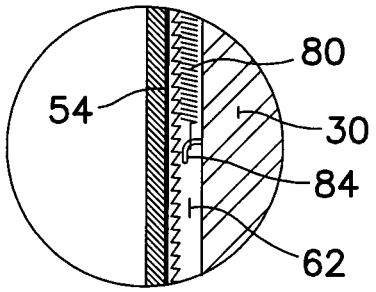
FIG. 8 is an enlarged illustration of the structural details included in detail circle 8 in FIG. 5.

In the preferred ratchet wrench 20 with fine socket-indexing mechanism, there is provided a second spring 80 mounted along the driven side spring seat 62, between the slider bar 70 and the shank 30 of the wrench. This second spring 80 prevents the occurrence of the effect of the capstan equation as mentioned before. This second spring 80 is referred to as the return-assist spring 80. This return-assist spring 80 has one end connected to the attachment point 82 of the driven end 60 of the belt 54 to the slider bar 70 as it can be better seen in FIG. 7. The other end of the return-assist spring 80 is attached to a second anchor hook 84 protruding from the shank 30 of the wrench along the driven side spring seat 62, as illustrated in FIG. 8. The return-assist spring 80 is an extension spring. The return-assist spring 80 and the return spring 64 have same physical and elastic properties.

Referring back to FIG. 5, the principle of operation of both springs 64, 80 will be explained. The portion of the ratchet gear 50 which is in contact with the toothed belt 54 can be divided into three segments "B", "C" and "D". The first segment "B" is on the return side of the ratchet gear 50. The second segment "C" is on the crest portion of the ratchet gear 50, and the last segment "D" is on the driven side of the gear 50.

The return spring 64 applies a tension force along the belt 54 along the first segment "B". The spring 80 applies a same compression force on the belt along the third segment "D". Both forces are oriented opposite from each other relative to the ratchet gear 50. Because both springs 64, 80 have same physical and elastic properties and a same elongation in use, there is substantially no surface pressure between the belt 54 and the crest segment "C" of the ratchet gear 50.

Although both springs 64, 80 work against each other relative to the ratchet gear 50, both springs 64, 80 contribute to apply forces in a same direction on the slider body 26, during both the driven movement and the return movement of the belt. Both springs 64, 80 apply forces in a same direction along the belt 54.

When the thumb knob 32 is pulled away from the box end 24 of the preferred wrench 20, the movement of the slider body 26 creates an unbalance between the springs 64 and 80 and causes the belt 54 to engage with the crest "C" and the driven "D" segments of the ratchet gear 50. A movement of the thumb knob 32 away from the ratchet gear causes the belt 54 to engage with all three segments "B", "C" and "D" of the ratchet gear 50, to turn the ratchet gear in a clockwise direction.

Figure 9:
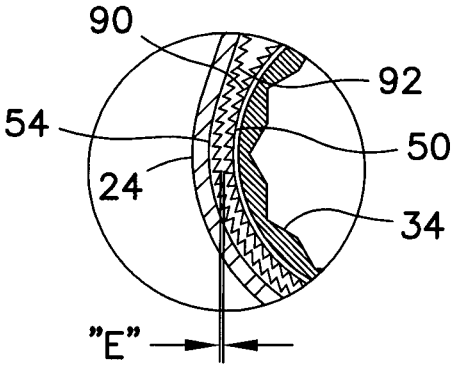
FIG. 9 is an enlarged illustration of the structural details included in detail circle 9 in FIG. 5.

When the thumb knob 32 is released, the return-assist spring 80 counteracts the tension force of the return spring 64, relative to the ratchet gear 50 causing the belt 54 to relax along the driven segment "D" and the crest segment "C" of the ratchet gear 50. Because the slider bar 70 slides along the wrench in a frictionless manner, the return-assist spring 80 pushes the belt 54 backward to force it to disengage from the ratchet gear 50 and to slide against the outside surface of the cavity in the box end 24 of the preferred wrench 20 as is illustrated in FIG. 9. The teeth 90 of the ratchet gear have inclined surfaces facing the driven end of the wrench. The teeth 92 on the belt 54 have inclined surfaces facing the opposite direction. The teeth 90 of the ratchet gear 50 and the teeth 92 on the belt 54 cooperate with the action of the return-assist spring 80 to push the belt 54 away from the segments "D" and "C" of the ratchet gear 50.

The inside cavity of the box end 24 includes sufficient space to accommodate the ratchet gear 50, the toothed belt 54 and a clearance "E" between the tips of the teeth of the belt 54 and the tips of the teeth of the ratchet gear 50. As a result, the toothed belt 54 can slide over the ratchet gear 50 during the return cycle, without touching the gear 50, as shown by the clearance "E" in FIG. 9.

The return spring 64 causes the belt 54 to slide easily over the return segment "B" of the ratchet gear 50. Because of the return-assist spring 80 basically, the capstan equation principle does not impede the operation of the preferred wrench 20. As a result, the operation of the preferred wrench is smooth, consistent and positive, without any sign of sticking or hesitation in its movement.

While one embodiment of the present invention has been illustrated in the accompanying drawings and described herein above, it will be appreciated by those skilled in the art that various modifications, alternate constructions and equivalents may be employed. Therefore, the above description and illustrations should not be construed as limiting the scope of the invention, which is defined in the appended claims.

What is claimed is:

1. A thumb-operated fine-indexing tangential drive mechanism for a ratchet wrench, comprising:

a longitudinal shank;

ratchet gear mounted at one end of said shank;

a belt having a semi-circular segment extending around said ratchet gear and a first and second parallel straight segments extending along said shank from respective ends of said semi-circular segment, to a mid-region of said shank;

a slider body including a thumb knob movably mounted over said mid-region of said shank for movement along said shank toward and away from said ratchet gear, said slider body being attached to said first straight segment of said belt;

a first spring attached to said slider body and to said shank;

a second spring attached, to said second straight segment of said belt and to said shank;

said first and second springs having a respective fix end attached to said shank and a respective extendible end moving in opposite directions of each other along said shank;

said first and second springs being mounted therein to jointly apply a force along said belt;

said first and second springs and said slider body being configured to increase said force along said belt and to cause said semi-circular segment of said belt to engage with said ratchet gear and to rotate said ratchet gear when said thumb knob is moved away from said ratchet gear;

said first and second springs and said slider body being also configured to reduce said force along said belt and to cause said semi-circular segment of said belt to disengage from said ratchet gear and to slide over said ratchet gear when said thumb knob is moved toward said ratchet gear.

2. The thumb-operated fine-indexing tangential drive mechanism as claimed in claim 1, wherein said belt is a toothed belt having teeth engaging said ratchet gear.

3. The thumb-operated fine-indexing tangential drive mechanism as claimed in claim 1, wherein said first and second springs have same physical and elastic properties.

4. The thumb-operated fine-indexing tangential drive mechanism as claimed in claim 1 further comprising a sleeve including a collar end mounted over said shank for limiting a movement of said slider body along along said shank.

5. A method for operating a ratchet wrench having a fine-indexing tangential drive mechanism therein, wherein said tangential drive mechanism comprising: the tangential drive mechanism for a ratchet wrench of claim 1; said method comprising the steps of:

continually applying a force along said belt;

momentary increasing said force along said belt by resiliently urging said first straight segment of said belt away from said ratchet gear causing said belt to engage with and to rotate said ratchet gear; and momentarily decreasing said force along said belt by resiliently urging said second segment of said belt toward said ratchet gear, causing said belt to disengage from and to slide over said ratchet gear, wherein said steps of momentarily increasing and momentarily decreasing are effected by moving a slide body along said wrench.

* * * * *